United States Patent [19]

Guggemos

[11] 4,051,362

[45] Sept. 27, 1977

[54] WALL MOUNTED HINGED BASE

[76] Inventor: Kenneth F. Guggemos, 135 Fairlawn Circle, Winsted, Minn. 55395

[21] Appl. No.: 664,511

[22] Filed: Mar. 8, 1976

[51] Int. Cl.[2] ..... F21S 13/10; F21V 21/00

[52] U.S. Cl. ..... 362/432; 248/289 R

[58] Field of Search ..... 116/173; 52/28, 726; 240/84, 52 R, 52.1, 73 R, 25; 248/240, 289 R, 221 R

[56] References Cited

U.S. PATENT DOCUMENTS

| | | | |
|---|---|---|---|
| 890,373 | 6/1908 | Orr | 52/28 X |
| 1,549,291 | 8/1925 | Broman | 248/289 R |
| 1,714,518 | 5/1929 | Owen | 240/73 DA |
| 1,848,430 | 3/1932 | Morris | 248/289 |
| 2,199,897 | 5/1940 | Stringer | 116/173 X |
| 2,653,002 | 9/1953 | Passman | 240/52 R X |
| 3,141,620 | 7/1964 | Guggemos | 240/84 X |
| 3,238,366 | 3/1966 | Schwartz | 240/73 R |
| 3,264,465 | 8/1966 | Rex | 240/52 R X |
| 3,671,738 | 6/1972 | Beachley | 240/84 |
| Re. 26,995 | 12/1970 | Guggemos | 240/84 X |

*Primary Examiner*—Donald A. Griffin

*Attorney, Agent, or Firm*—Dugger, Johnson & Westman

[57] ABSTRACT

A wall mounted hinged base providing a strong, attractive and convenient structure for mounting a luminaire to a building wall, thereby saving the cost of a lighting pole and foundation. The base is easily installed and has a hinge axis that may be placed on either the right or left hand side of the mounting base.

10 Claims, 4 Drawing Figures

WALL MOUNTED HINGED BASE

BACKGROUND OF THE INVENTION

1. Field of the Invention

The present invention relates to hinged base lighting devices for mounting onto upright walls of buildings.

2. Prior Art

Lighting devices having hinged bases are exemplified by my own U.S. Pat. No. 3,141,620 which shows a pole having a hinged base mounted on a foundation and U.S. Pat. Re. No. 26,995 which shows a base recessed into the ground.

Heretofore, when mounting a lighting pole and luminaire in close proximity to a building, it has been desirable to mount the luminaire directly onto the building, thereby saving the expense of a lighting pole, concrete foundation, underground wiring, etc.

However, there has not been available any kind of wall mounting base that would provide the same convenience or utility as was provided by a lighting pole, such as: high strength, ease of installing, hinging open to either right or left for ease in servicing, and aesthetically attractive styling. The present invention accomplishes all of these desirable features in a simple, low cost unit, and does thereby save valuable resources.

SUMMARY OF THE INVENTION

The present invention relates to a wall mounted hinged base assembly having two portions, namely a cover which is hingedly attached to a base portion, and which symmetrically mounts a mast and luminaire. The cover hinges about a strong, substantially hidden hinge. The base portion of the base assembly, which attaches to the wall on which the unit is mounted, provides for an enclosure in which wire connectors can be placed when the luminaire is wired. The wall of the base which is attached to the upright wall of the building includes mounting apertures that have keyhole type slots for ease of attachment to existing pairs of studs or anchor bolts, so that the base can be hung on the anchor bolts prior to being fastened into place, with the hinge properly oriented. The additional anchor bolts or studs can be inserted into provided openings and the base assembly securely attached. The keyhole slots are oriented so that the narrow portion (tang portion) of the slot on opposite sides of the base extend toward the outside of the base. As will be seen with reference to the drawings, the hinged base can therefore be supported on the top pair of the keyhole slots regardless of which side the hinge is on.

In this way the base is a universal base that can be mounted with the hinge on either side of the base.

The hinge is made so that the base portion has a pair of recesses along one edge thereof. A cover member to which the standard for the luminaire is attached has mating ears that fit within the recesses, and are formed so that when pinned in place the cover may be pivoted from a closed position overlying the base portion to a position substantially 90° to the closed position so that the interior of the base portion, and the bottom side of the standard and cover plate are accessible for connecting wires. Then, when the cover is closed the cover rests against the outer edge of the base housing, and is held in place with cap screws of suitable design. Normally a socket head screw would be utilized for holding the cover securely in position.

The opening on the interior of the base portion through which the wiring extends, that is, the opening that leads to conduits or to a junction box, is off-center with respect to the chamber in which it is formed so that it is centered with the outside periphery of the base portion, and thus it is easy to center the standard supporting the luminaire with respect to the outside peripheral dimensions of the cover, because the wiring opening through the bottom of the base housing would be centered with respect to the center of the luminaire.

The base housing and the cover are made so that they can easily be cast in aluminum, therefore being lightweight and relatively low cost. The unit can also be used with flush mounted supply conduits, and bosses are also provided on the insides of the walls of the base portion for attaching flush or surface mounted conduits.

DESCRIPTION OF THE PREFERRED EMBODIMENT

Figure 1:
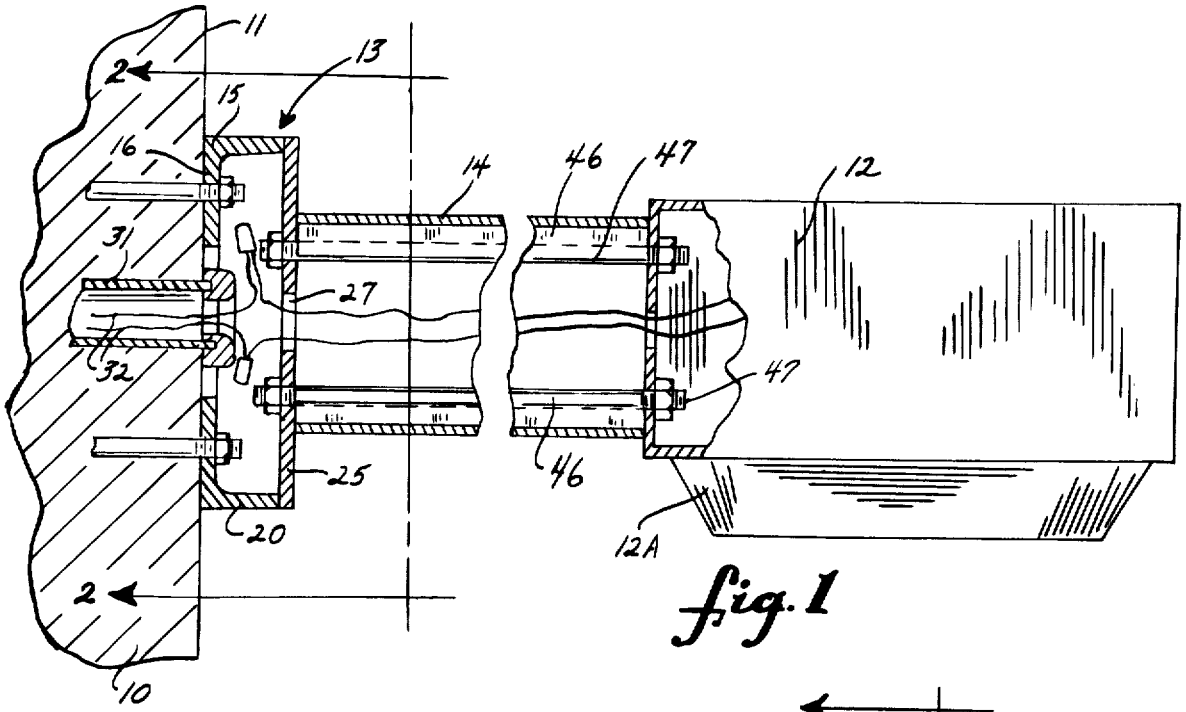
FIG. 1 is a side elevational view of a wall mounted hinged base made according to the present invention.

As shown in FIG. 1, an upright wall, indicated generally at 10, for example a building wall, has an upright surface 11 on which a light is to be supported. The lamp housing indicated generally at 12 mounts a suitable bulb, and includes a diffuser 12A in a normal construction. The lamp housing is attached to the building wall 11 through the use of a hinged base assembly 13. The hinged base assembly 13, as will be more fully explained supports a rectangular cross section mast arm 14 that in turn supports the lamp housing 12. The arm 14 can be attached to the housing and to the base assembly in any desired manner.

Figure 2:
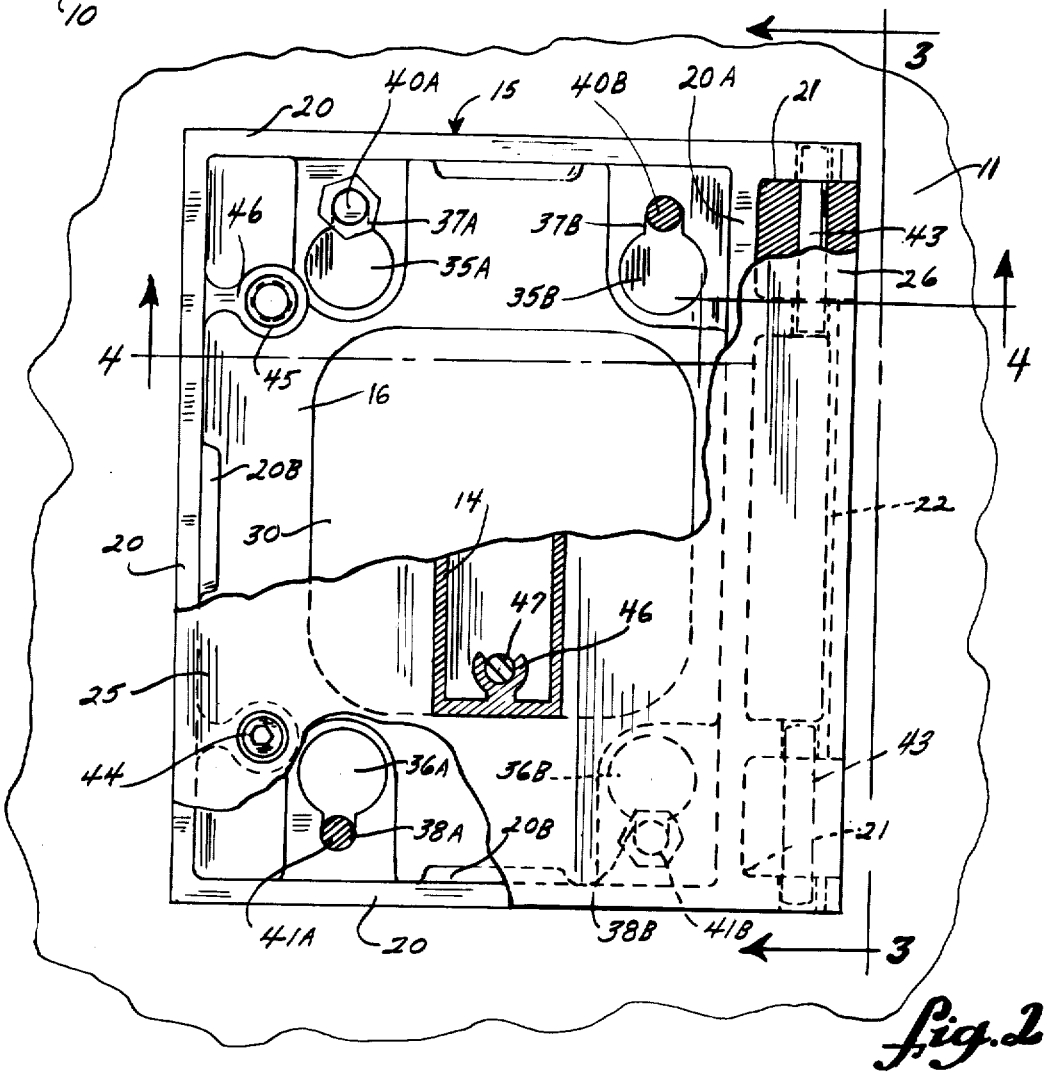
FIG. 2 is a front elevational view of the device of FIG. 1 and taken as on line 2—2 in FIG. 1 with parts in section and parts broken away.
Figure 3:
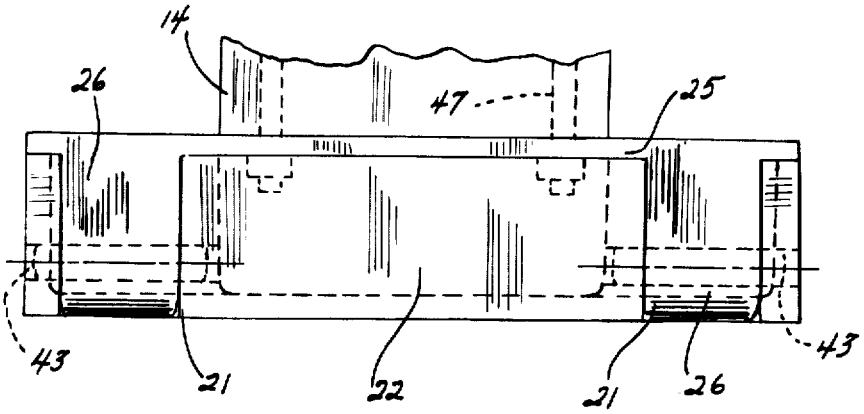
FIG. 3 is a view taken as on line 3—3 in FIG. 2.

Referring now to FIG. 2, the base assembly includes a housing portion or base portion 15, that has a bottom wall 16 that mounts flush against the surface 11, and in the form shown, the base housing defines a generally rectilinear (almost square) enclosure through the use of a periphery bounding wall 20 that is attached to the bottom wall 16, and extends outwardly therefrom at generally right angles. The wall 20 extends on three sides of the enclosure and joins a partition wall 20A that bounds an interior chamber. On the side of the base housing 15 to the exterior of wall 20A a pair or recesses indicated generally at 21, are defined adjacent the sides of the base, as shown in FIG. 2. Between these recesses 21, there is a vertical outside wall 22, that forms the outer surface along the hinging side of the base housing and extensions of side walls 20. The outer sides of the recesses, and the inner sides of the recesses are also bounded by wall portions. It should be noted that the recesses 21 both extend the full depth of the base housing, that is, they extend from the bottom surface of the wall 16, to the top edge of the walls 20 and 20A, as can perhaps best be seen in FIGS. 3 and 4.

A cover member illustrated generally at 25 comprises a generally planar wall member, having a pair of downwardly depending ears 26 adjacent one side thereof, which ears extend along a plane with the edge of the wall forming the cover 25 and are flush with the outer surface of wall 22 when installed. The ears 26 mate with and fit closely into the recesses 21 along the hinge edge of the base housing 15. The cover member 25 includes a central opening 27 (FIG. 1) that is centered with respect to the periphery of the cover member, and adjacent the edge of the cover member opposite from the ears 26, a pair of openings are provided through which cap screws can pass for securing the cover to the base housing, when the cover is in its closed position as shown in FIG. 2.

Also, as fragmentarily shown in FIG. 2, the wall 16 has a large opening 30 therethrough, through which wires and conduit ends can pass. For example, where a conduit 31 is used in the wall 10, the wiring indicated generally at 32 can pass through the conduit, and the conduit will pass through the opening 30.

The opening 30 is centered with respect to the exterior dimensions of the base housing 15, and therefore, as shown in FIG. 2, is not centered with respect to the chamber defined by the walls 20 and partition wall 20A. However, the opening 30 is centered with respect to the opening 27, which in turn is centered on the cover member 25, and because of the hinge members, namely recesses 21 and ears 26 adjacent one side of the base assembly, the opening 30 is therefore not centered in the interior chamber.

Also centered on the exterior dimensions of the base housing, and positioned adjacent opposite edges of the base housing (as shown the upper and lower edges) are a plurality of mounting apertures indicated generally at 35A and 35B, and 36A and 36B. As can be seen, these apertures are generally keyhole type openings, having slot or tang portions 37A and 37B, and 38A and 38B, respectively.

It can be seen that the slot portions 37A and 37B, and 38A and 38B extend from the main portions of the apertures toward the adjacent peripheral wall, and that the tangs or slots of one pair of apertures therefore extend in direction away from the slots of the other pair. That is, the slot portions 37A and 37B extend toward the adjacent wall and in direction away from the slot portions 38A and 38B which also extend toward the adjacent side wall of the base housing.

Mounting studs or anchor bolts 40A and 40B are used to support the housing through the apertures 35A and 35B and slot portions 37A and 37B and suitable mounting bolts or studs 41A and 41B are used with respect to the slots portions 38A and 38B.

As can be seen, the side walls defining the recesses 21 having openings therethrough aliging with provided openings in the ears 26, through which suitable spring pins 43 can be passed for forming a hinge pin. The spring pins will fit tightly in the opening in the ears 26, but will be rotatable in the openings in the walls of the base housing forming the sides of recesses 21 to provide a hinge action.

The hinge pins are close to the plane of the mounting surface of wall 16. The hinge axis is substantially closer to this plane than to the plane of the outer edges of walls 20. In fact, the axes of pins 43 are at the center on the ears 26 in direction parallel to the plane of the mounting surface of wall 16 and are spaced above said plane an equal distance to the center distance. The end surfaces of ears 26 thus are part cylindrical surfaces centered on the axes of pins 43 so when the cover is pivoted, the ends of ears 43 clear the mounting surface and the inner surfaces of the recesses 21.

Cap screws, one of which is indicated generally at 44 in FIG. 2 pass through opening in the cover 25 and are threaded into steel inserts 45 that are in turn forced into cast-in lugs or bosses 46 adjacent the wall 20 of the base housing 15 opposite from the hinge side. Bosses 25A on the cover rest on the bosses 46.

The cap screws 44 serve to tighten the cover plate down against the upper edges of the wall 20, to securely hold the cover plate in position in combination with the hinge pins.

As stated previously, the standard 14 can be held in place on the cover 25 with a variety of ways. As shown, the arm 14 is an extruded aluminum member having tension rod supports 46 attached to the walls thereof (see FIG. 2 as well as FIG. 1) and threaded tension rods 47 supported on the supports 46 extend through provided apertures in the lamp housing 12, and through provided apertures in the cover 25. These rods 47 can then be threaded tightly with suitable nuts, to clamp the arm 14 between the lamp housing 12 and the cover 25 to hold the unit as a fixed assembly. Also, the arm 14 can be welded to the cover 25, or could be attached to a collar that would be bolted directly to the cover 25. Any suitable form of attaching the arm 14 can be used.

Figure 4:
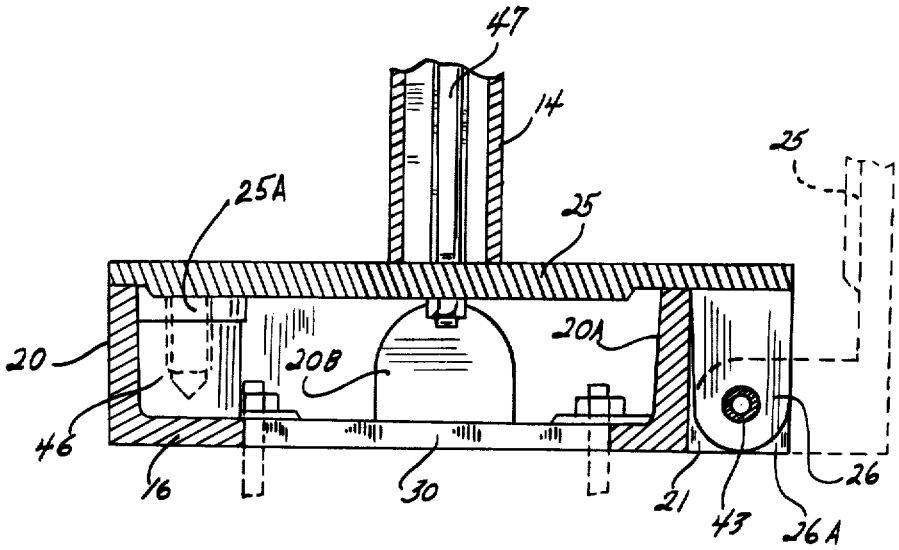
FIG. 4 is a sectional view taken along line 4—4 in FIG. 2.

As stated, the lower ends of the ears 26, as shown in FIG. 4, have a rounded part cylindrical surface 26A centered on the center axis of the pins 43, so that the hinged cover 25 can rotate without having interference of the ends of the ears with the mounting surface 11 or with the wall 20A as the cover pivots. When the cover is hinged or pivoted to position as shown in FIG. 4, the arm 14 or lamp housing will swing about the vertical pivot axis of the pins 43, shown in FIG. 2. The interior of the base housing 15 is then completely accessible so that the wiring can be done easily. Connectors and wire lengths can be placed in the chamber formed by the walls 20 and 20A. When the cover 25 is to be closed, it is pivoted into position overlying the base housing and the cap screws 44 are then used for tightening the cover securely to the top of the base housing.

It should be also noted that suitable sealing strips (resilient foam tape for example) can be placed along the top edges of the walls 20 and 20A, to seal the interior chamber completely from atmosphere if desired.

One of the features of the present device is that it is usable with the hinge axis on either side of the housing assembly when it is installed. For ease of installation, the keyhole apertures can be used for initial support. The upper pair of studs or anchor bolts can be installed before the housing is supported. For example in FIG. 2, if the anchor bolts 40A and 40B are in place, but the anchor bolts 41A and 41B are not in place, the base housing 15 may be placed on the upper anchor bolts and the base housing will be supported in the keyhole slots 37A and 37B. The bolts or studs slip into tangs of the slots to hold the base housing securely until the nuts are placed onto bolts 40A and 40B, then the bolts 41A and 41B can be fastened into the wall. When installations are to be made with the hinge axis on the opposite side of the base assembly, the base assembly is rotated 180°, and then the keyhole slots 38A and 38B are at the top edge, and the hinge axis is vertically extending and on the left-hand side of the base assembly, as viewed in FIG. 2. The top pair of the keyhole slots are used to support the base initially, until such time as the other anchor bolts are put into place, thereby simplifying installation for either right or left hand hinging. The universal oppositely directed keyhole slots permit this ease of initial installation with either right or left hand hinging.

The base assembly is thus relatively easy to install, low in cost, and provides a secure heavy duty assembly. The cast-in ears 26 on the cover have surfaces that are generally planar with the outer surface of wall 22 on the hinge side of the base housing 20, when the cover is in closed position, so that the hinge is almost perfectly concealed. This forms an attractive assembly. Because the opening 30 in wall 16, which provide access to the wiring conduit or junction box, and the keyhole mounting slots, are centered with respect to the outer periphery of the base housing rather than with respect to the chamber on the interior of the housing, the exterior of the base housing will be centered on the wiring source (junction box or conduit). The arm 14 also is centered on the outer peripheral dimensions of the base assembly and therefor aligns with opening 30 and the wiring source. A very attractive, symmetrical, hinged base assembly with a vertically extending hidden hinge for mounting onto vertical surfaces is provided.

The walls 20 have bosses 20B on the interior thereof. The bosses 20B provide areas where surface conduits can be connected if desired.

The surface of base wall 16 against the upright surface 11 can be sealed or weatherproofed if desired to keep moisture out of the interior chamber and out of junction boxes or conduits under the base.

What is claimed is:

1. A hinged base assembly for mounting onto generally upright surfaces comprising a base housing including a base wall having first means adapted to rest on an upright surface on which it is to be mounted, and a plurality of side walls attached to said base wall and extending outwardly therefrom to define an interior chamber having a depth extending from said first means to outer edges of said side walls, a cover member overlying the side walls, means to hingedly mount said cover member to said base housing adjacent one upright edge thereof about an upright axis, said side walls including two spaced, generally parallel side walls extending at right angles to said one upright edge, and mounting slot means defined in said base, wall of said housing comprising at least four keyhole slots arranged in pairs, each pair being adjacent one of the two side walls of said base at right angles to said one upright edge, said keyhole slots each having a main aperture portion and a single bolt receiving tang portion of smaller transverse dimension than said main aperture portion, the tang portions of each pair of slots extending toward the adjacent side wall only and facing in opposite direction from the tang portions of the other pair of keyhole slots, said keyhole slots in each pair being spaced apart an amount equal to the spacing of the other pair of keyhole slots, said tang portions having end surfaces aligning along a line parallel to the respective adjacent side wall and at substantially an equal distance from the side wall as the distance of the end surfaces of the tang portions of the other pair of keyhole slots from its adjacent side wall to permit rotating the base housing to place the means to hingedly mount on either side of the housing and having the tang portions of one pair of keyhole slots extending upwardly to form interchangeable support for the housing adjacent the upper of the two side walls.

2. A hinged base assembly for mounting onto generally upright surfaces comprising a base housing including a base wall having a first surface generally defining a first plane adapted to rest on an upright surface on which it is to be mounted, and a plurality of side walls attached to said base wall and extending outwardly therefrom, a partition wall attached to said base wall and extending between two side walls and spaced from a third side wall to define an interior chamber having a depth extending from said first surface to a second plane defined by the outer edges of said side walls, means on said housing adjacent one side of said housing defining a pair of spaced recesses extending inwardly from one side wall to said partition wall, said recesses being defined by wall means having surfaces forming the sides of said recesses and extending from said first surface the full depth of said side walls, a cover member overlying the side walls and partition wall and having a pair of ears depending therefrom, means to pivotally mount each of said ears to adjacent wall means defining one of said recesses, each of said ears fitting closely between two side surfaces defining the respective recess, and also extending substantially to the first plane and having rounded ends to permit pivoting of said cover between a first position overlying and seated on the edges of said side walls and partition wall defining said interior chamber and a second position to permit access to the interior of said housing, and means on said cover for mounting a luminaire thereon.

3. The combination as specified in claim 2 and mounting slot means in said base wall comprising a pair of keyhole type openings aligned on a line adjacent one side wall generally at right angles to the wall defining said recesses, and positioned to the interior thereof, said openings having narrow tang portions extending toward an adjacent side wall to permit securely supporting said housing on the surfaces defining said tang portions under gravity.

4. The combination as specified in claim 3 wherein said housing includes four keyhole openings arranged in pairs adjacent opposite side walls, the tang portions on said keyhole openings extending toward the respective adjacent side wall, so that the tang portions of one pair of two keyhole openings extends in opposite direction from the tang portions of the other pair of keyhole openings.

5. The combination as specified in claim 2 wherein said means to pivotally mount said ears comprises pin means positioned substantially closer to said first plane than to the plate portion of said cover member so that the pivot axis is adjacent and parallel to said first plane and wherein said rounded end surfaces of said ears are adjacent to said first plane.

6. The combination as specified in claim 2 wherein said means to mount a luminaire comprises a tubular mounting arm mounted to the outer surface of said cover plate portion and a luminaire mounted at the outer end of the mounting arm, wire means for said luminaire extending through said arm, said plate portion of said cover having an opening centered on the outer periphery of said cover, and an access opening through said base wall, said access opening being generally centered on the outer peripheral dimensions of said base housing, and therefore eccentrically mounted with respect to the interior chamber of said housing.

7. The combination of claim 2 wherein said rounded surfaces on said ears comprise part cylindrical surfaces centered on the axis of pivot of said ears, said axis of pivot being substantially closer to said first plane than to the outer edges of said side walls.

8. The combination of claim 2 and boss means on said two side walls and said third side wall formed to extend into the interior of the interior chamber of the base housing and positioned to align and permit electrical conduits positioned on the upright mounting surface to be fastened to said boss means.

9. A hinged base assembly for mounting onto generally upright surfaces comprising a base housing including a base wall having support means adapted to rest on an upright surface on which the base is to be mounted, and a plurality of side walls attached to said base wall and extending outwardly therefrom to define an interior chamber having a depth extending from the base wall, a cover member overlying the side walls, means to pivotally mount said cover member to said base wall adjacent one edge thereof about a pivot axis positioned between the base wall and the outer edges of said side walls, at least two of said side walls being spaced apart, generally parallel and extending at substantially right angles to said pivot axis, said means to pivotally connect being positioned to permit pivoting of said cover to a position to permit access to the interior of said housing, means on said cover for mounting a luminaire thereon, said base wall having mounting slot means defined therein comprising a pair of keyhole type openings each having a main portion and a narrow tang portion, said tang portions each having a longitudinal axis and end support surfaces, the end support surfaces being aligned on a line adjacent one side wall generally at right angles to said pivot axis and positioned in said interior chamber, said narrow tang portions extending toward said adjacent side walls from the main portion to permit temporarily support said housing on the end support surfaces of said tang portions under gravity, and additional aperture means in said base wall spaced from said keyhole type openings in direction toward the other of said two side walls to permit securing said housing to an upright wall after temporarily supporting said housing.

10. The combination as specified in claim 9 wherein said additional aperture means comprise an additional pair of keyhole openings adjacent the other of said two side walls positioned relative to the other of the two side walls in substantially identical relationship thereto as the first mentioned pair of keyhole openings with respect to said one side wall, said tang portions of one pair of keyhole openings thereby extending in opposite direction from the tang portions of the other pair of keyhole openings.

* * * * *